United States Patent [19]

McCarty, Jr.

[11] 4,193,567

[45] Mar. 18, 1980

[54] GUIDANCE DEVICES

[75] Inventor: Lewis C. McCarty, Jr., Scarborough-on-Hudson, N.Y.

[73] Assignee: Novatronics, Inc., Pompano Beach, Fla.

[21] Appl. No.: 210,443

[22] Filed: Jul. 17, 1962

[51] Int. Cl.[2] ..... F42B 15/18

[52] U.S. Cl. ..... 244/3.16

[58] Field of Search ..... 102/3, 49, 50; 244/14; 250/203; 318/480

[56] References Cited

U.S. PATENT DOCUMENTS

| | | | |
|---|---|---|---|
| 2,822,755 | 2/1958 | Edwards et al. | 244/3.22 |
| 2,935,942 | 5/1960 | Young et al. | 244/3.16 |
| 2,974,594 | 3/1961 | Boehm | 244/3.22 |
| 3,072,055 | 1/1963 | Ross | 244/3.16 |

FOREIGN PATENT DOCUMENTS

| | | | |
|---|---|---|---|
| 832427 | 7/1938 | France | 244/3.16 |

*Primary Examiner*—Verlin R. Pendegrass

*Attorney, Agent, or Firm*—Oltman and Flynn

EXEMPLARY CLAIM

1. A guidance system mounted on a projectile comprising first and second sections mounted on the projectile to rotate about the longitudinal axis thereof, means for rotating said first section when the projectile is in flight, sensor means including a part removed from the longitudinal axis of the projectile rotatable with said first section for receiving emanation from a target and emitting a signal pulse in response thereto when the said part is facing the target and the longitudinal axis of the projectile and the target lie in a straght line, means including said second section for applying a steering force to the projectile at a point rotatable with said second section and directed perpendicularly to the longitudinal axis of the missile, means for rotating said second section when the projectile is in flight, means for generating a position pulse when said first and second sections are in such relation that the steering force tends to steer the missile in the direction in which said part is facing and means responsive to coincidence of said signal and position pulses for deactivating said means for rotating said second section.

12 Claims, 10 Drawing Figures

Figure 1:
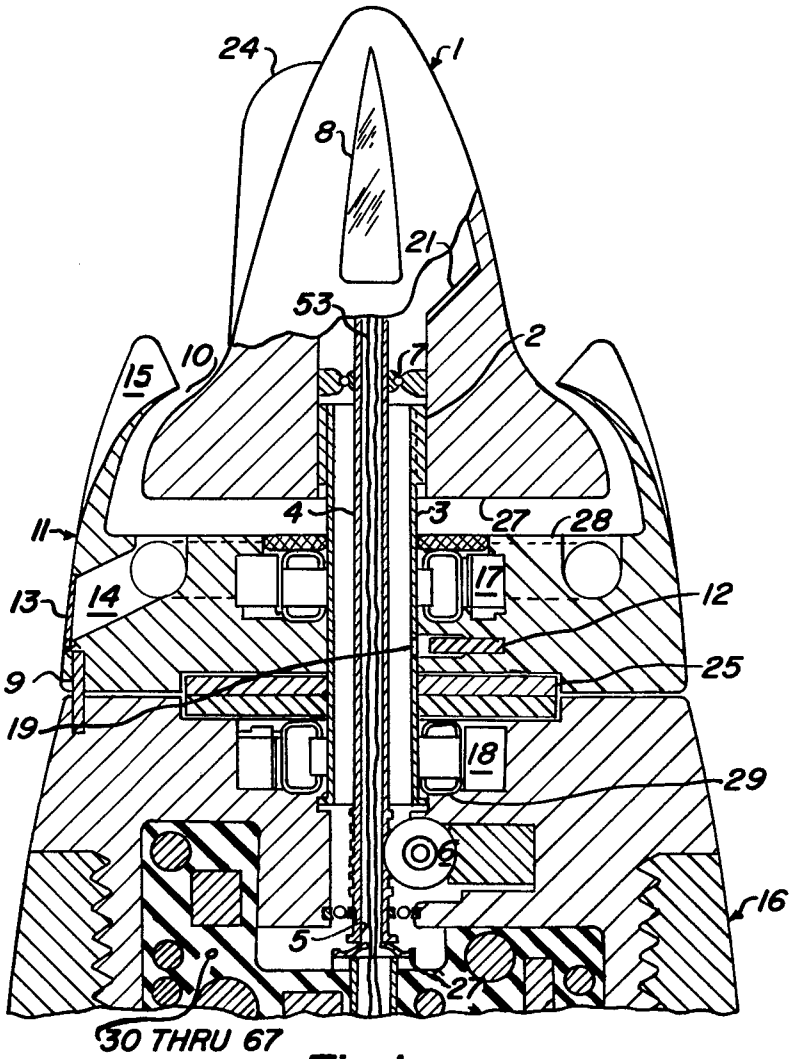

Fig. 4
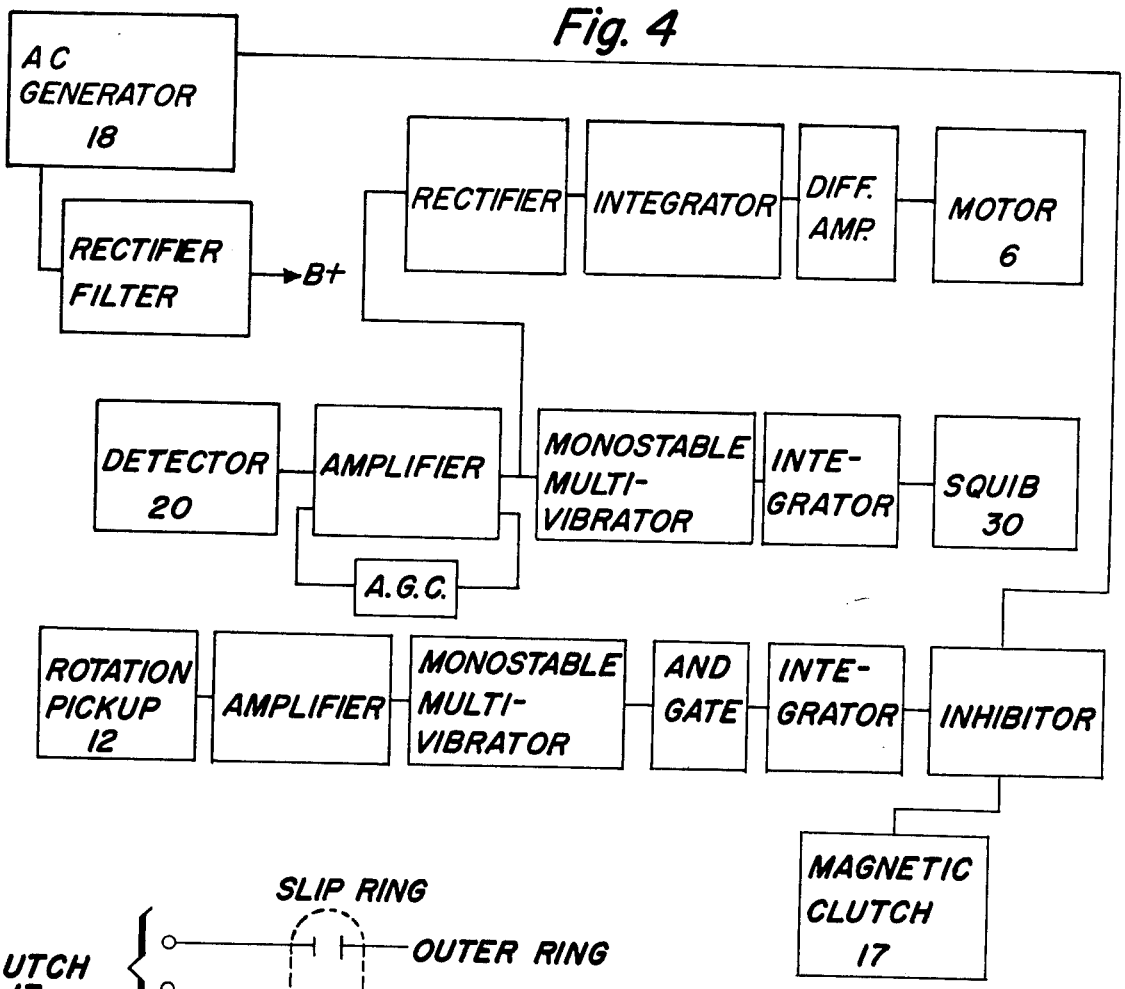
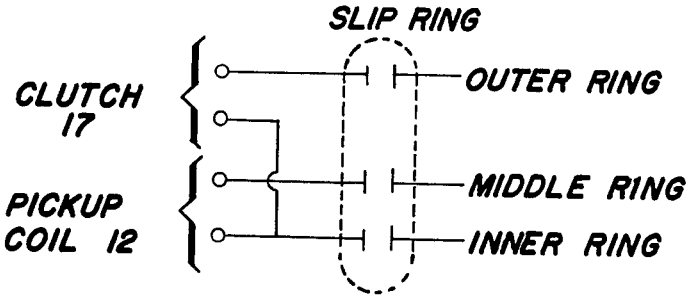
Fig. 3
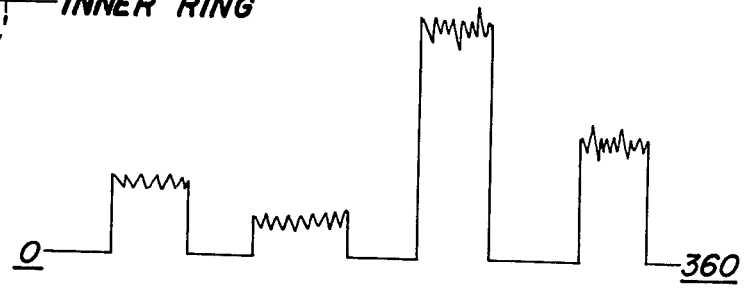
Fig. 6
Fig. 7
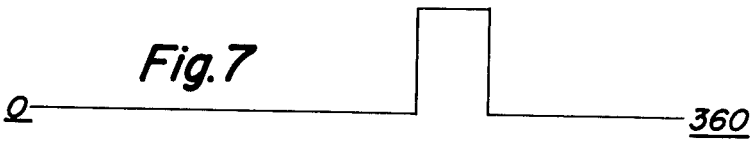

GUIDANCE DEVICES

The present invention relates to a guidance system for missiles and other projectiles.

There is at present a need for a low cost, effective, lightweight, self-contained and reliable target-seeking guidance or orienting device for missiles and other projectiles. The term missile is intended to include torpedoes, depth charges, rockets, projectiles, mines, similar explosive weapons, and other devices which travel through a fluid medium such as rockets used to carry mail and other commodities.

It is, therefore, an object of this invention to provide an improved, target-seeking guidance or orienting system for missiles which is low-cost, self-contained and reliable.

It is another object of this invention to provide a guidance system for missiles in which no major modifications of existing missiles is necessary.

It is a further object of this invention to provide a guidance system for missiles wherein a scanning and steering system on the missile reacts to stimuli emanating from a target so as to provide a constant steering force toward the target.

It is a more particular object of this invention to provide an optical scanning system for missiles wherein stimuli such as infrared radiation from a target is passed by a slit in a rotating element as the slit scans the target to activate a photosensitive sensor to produce a pulse. This pulse is amplified and cooperates with other devices to position a jet or jets on another rotatable section of the missile to steer the missile toward the target.

It is a still further object of this invention to provide a missile guidance system in which the missile will be steered toward the target by reacting to sonic or ultrasonic stimuli.

It is a still further object of this invention to provide a missile guidance system in which the missile will be steered toward the target by reacting to emanation reflected from a target.

It is a still further object of this invention to provide a missile guidance system in which a missile or projectile has on it a rotatable section with means rotatable with said section to pass stimuli emanating from a target during that portion of each revolution when a part of the passing means lies in a plane formed by the longitudinal axis of the missile and the target. This stimuli sends a pulse to a steering means comprising jets on another rotatable section which will steer the missile in a direction formed by a line passing through the passing means and the target in response to the pulse.

It is an important object of this invention to provide an improved guidance device for missiles in which the drag on the projectile when passing through the air is minimized.

It is still another important object of this invention to provide a steering means for missiles which is responsive to emanation from a target in which the steering is proportional to the duration of the emanation during each scan. For example, for large bearing angles, the steering force is increased.

Figure 2:
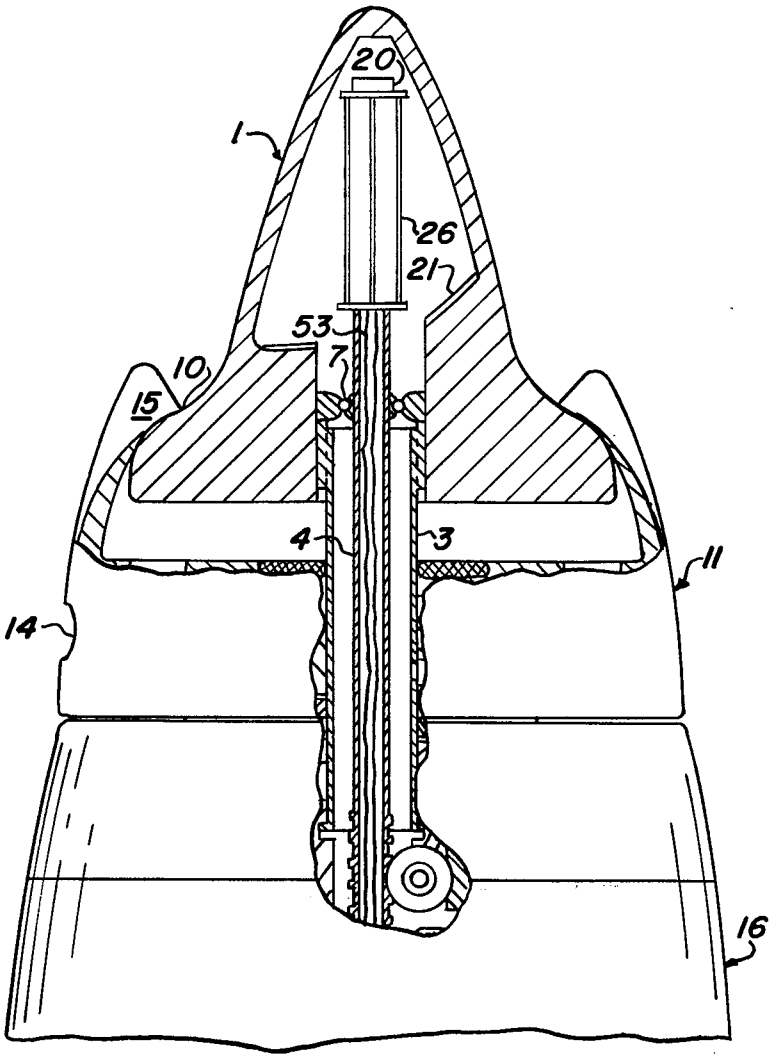
Figure 5:
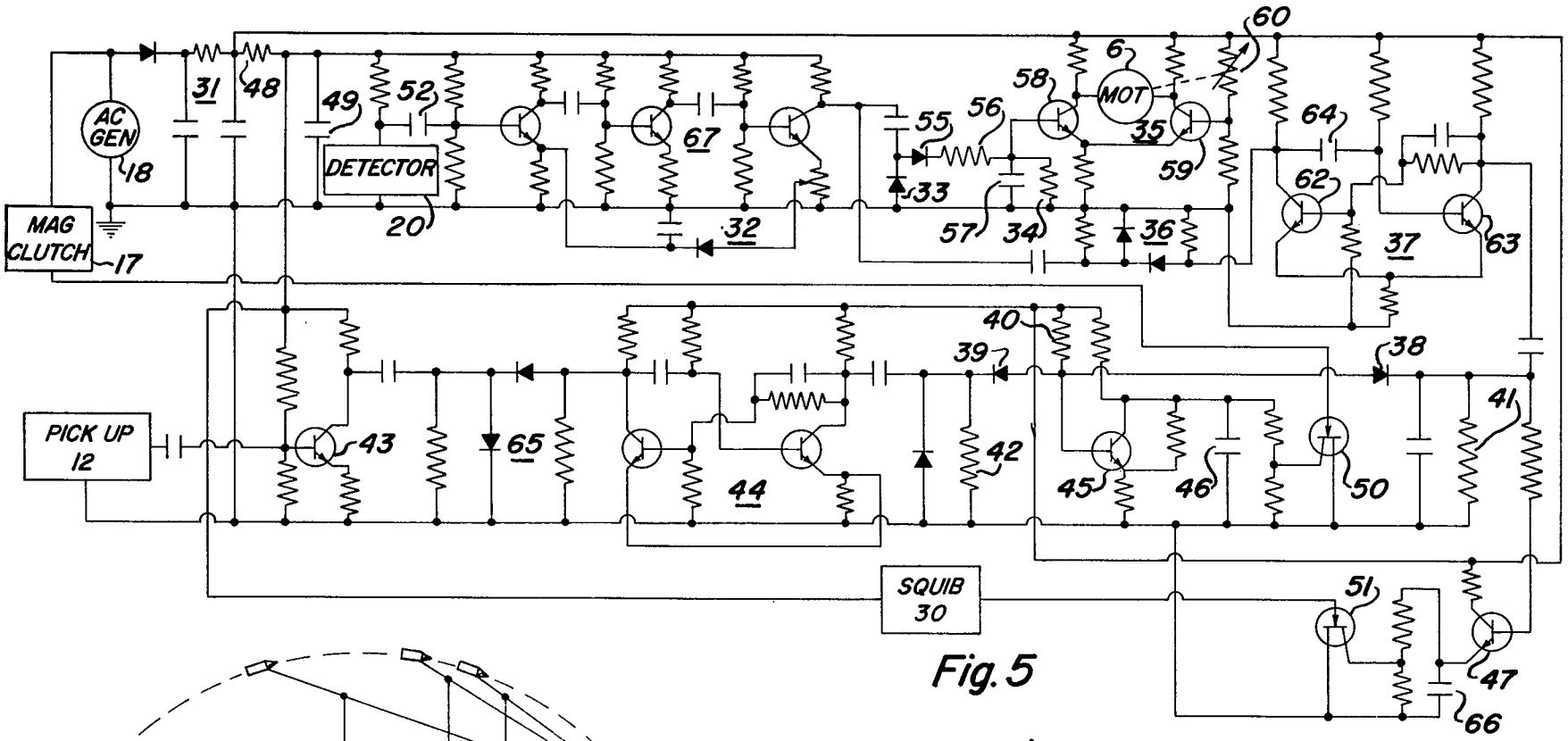
Figure 9:
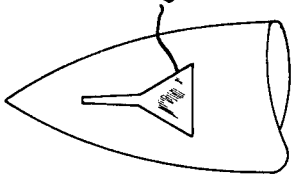
Figure 10:
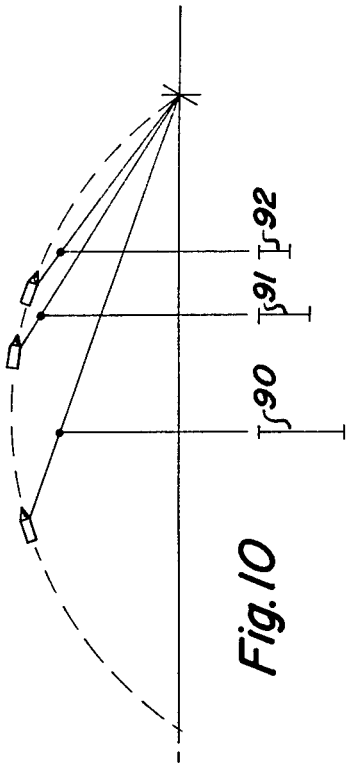
Figure 8:
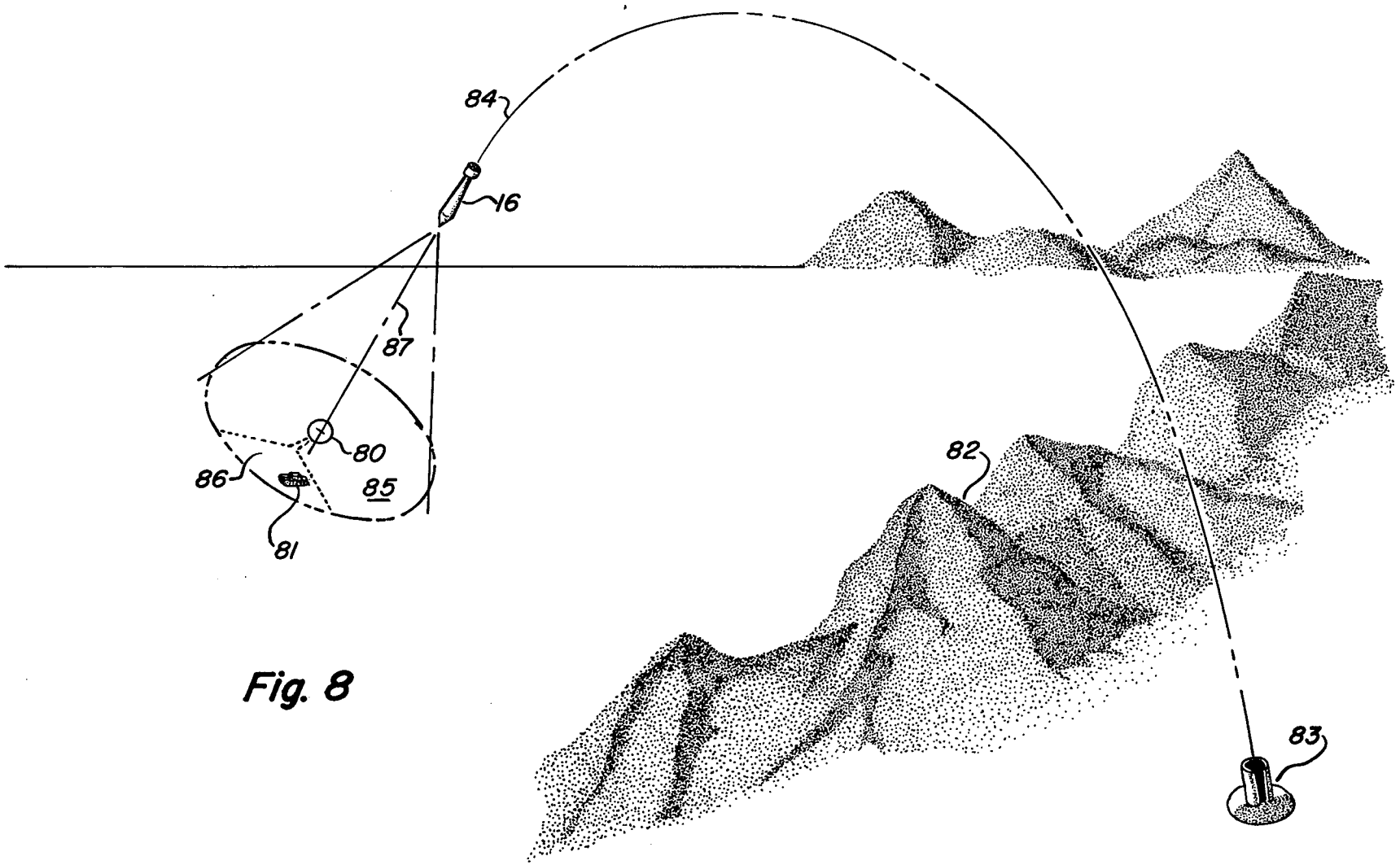

Other and more specific objects of this invention will become apparent as the description proceeds when taken in connection with the accompanying drawings, illustrating preferred embodiments in which:

FIG. 1 is a view, partially in cross-section, of a missile guidance system in accordance with the invention, FIG. 2 is another view showing more details of the nose assembly, FIG. 3 is a schematic view of the slip-ring arrangement, FIG. 4 is the block diagram for the electronics, FIG. 5 is a schematic diagram of the electronics, FIG. 6 is a diagram showing pulses emitted by the detector during a 360° scan, FIG. 7 is the output of the amplifier 67 during a 360° scan, FIG. 8 is a view showing the operation of the device, FIG. 9 is a view showing a configuration of the slit for controlling pulse duration as a function of angle, and FIG. 10 shows schematically the pulse duration as a function of bearing angle.

Reference is hereby made to U.S. application, Ser. No. 176,141, assigned to the assignee of this invention. This application represents a further improvement of guidance devices.

MECHANICAL DESCRIPTION

FIG. 1 and FIG. 2 disclose the mechanical part of the guidance device mounted on the missile body 16. The nose 1 is mounted on a hollow shaft 3 by means of a spline 2 to allow the nose to move axially. On the nose is a fin 24 which will rotate the cone during the flight. While the fin configuration is not critical, the preferred form is that of a skewed fin to cause rotation.

The nose cone includes a target scanning slit 8 preferably constructed as shown in FIG. 9 but shown as triangular in FIG. 1 for simplicity which is transparent to the types of emission, such as infrared radiation, capable of being detected by the detector 20. The emission from the target is passed by the slit, collected on the mirror 21 and focused on the detector 20. In FIG. 1 the nose cone, and slit 8, is rotated 90° from its true position to facilitate illustration. The true position of the nose cone is 90° to the viewer's right as viewed in FIG. 1 with the slit 8 lying on the side of the missile opposite the fin marked 15.

According to the illustrated embodiment of this invention, the mirror 21 may be made of a high stability plastic having a coating of aluminum which is a first surface parabolic reflector. This is intended as an illustration only as it is within the scope of this invention to use any satisfactory mirror.

During a complete revolution of the nose section, the detector will "see" any object within a cone except for a blind spot 80 (see FIG. 8). The radiation of any object in this cone is collected by the mirror and focused on the detector 20, mounted on squirrel cage 26.

This detector may be any conventional detector such as an uncooled gold-doped germanium thermistor with a usable band width of 9 microns and with a noise equivalent power of approximately $10^{-9}$ watts. This represents an absolute threshold for the system so that any target whose radiant intensity at the detector is at least one order of magnitude greater than this, say $10^{-8}$ watts, would provide sufficient information to control and guide the round.

For example, assuming the earth to be a black body with an emittence of 460 watts per square meter a target one meter square and at a temperature of 500° Fahrenheit would be ten times brighter than the background and would be sufficient to activate the detector.

As the detector receives the radiation it will put out a series of pulses which will vary in amplitude and duration as shown in FIG. 6 illustrating typical pulses received during one 360° scan. The amplitude of each pulse will depend on the strength of the radiation and the duration will depend on the size of the target and the angular distance of the target from the projected longitudinal axis of the missile with the duration decreasing as the angular bearing of the target decreases. This may be accomplished, for example, by constructing the slit with a configuration such as shown at 88 in FIG. 9.

If desired, the mirror rather than, or in addition to, the slit can be constructed to reflect emanation from a target so that a target with a wide bearing angle is "seen" more during each revolution than a target having a small bearing angle. In any event, the duration of pulses emanating from a target increases as the bearing angle increases for a purpose to be explained later.

Shown at 53 are the electrical leads for the detector which lead to the electronics in the missile.

The detector 20 and squirrel cage 26 are mounted on the non-rotating hollow push rod 4. This push rod, driven by worm 5 and a small permanent magnet D.C. motor 6, serves to drive the nose axially on the shaft 3 opening the cowling duct 10 between the nose 1 and cowl 11 upon acquisition of target pulses. Rotary independence between the push rod and nose is provided by the radial and thrust bearing 7. The motor 6 is sufficiently strong to withstand stalls at full current.

This axial motion provides not only for initial opening of the duct on target acquisition, but may serve to close the duct on target and further may proportionally control the duct opening as a function of the duration of pulses from the slit 8, thus providing proportionally increased control for large target-bearing angles which may be reduced and finally brought to zero when the missile is on target.

While the nose 1 and cowl 11 are shown as contacting in FIG. 2, in actual practice a small clearance is maintained to allow relative rotation.

The cowl 11 is rotatably mounted on the hollow shaft 3. Fins 15 are provided which during flight serve to stabilize the cowl and prevent spinning.

An explosively actuated pin 9 and diaphragm 13 serve to hold the cowl 11 fixed with the main body. The body of the pin 9 is flush-mounted with respect to the surface of the cowl and body. When the pin is electrically actuated it explodes, destroying itself and the leads to permit the cowl to rotate. At the same time, the diaphragm 13 is destroyed, permitting air flow from jet duct 14 fed by the duct 10. It is this jet, directed sidewardly relative to the missile, that provides the side thrust to guide the missile. This thrust has a major steering component (steering force) normal to the longitudinal axis of the missile.

Attached to the rotary shaft 3 is the permanent magnet rotor of clutch 17. The windings for the clutch are located in the cowl 11 and are supplied with current from the slip-rings shown schematically in FIG. 3. When the clutch is engaged, the cowl 11 and shaft 3 are coupled causing rotation of cowl 11 and hence jet 14.

Mounted in the cowl 11 is a coil 12 which will generate a position pulse when the reluctance hole 19 in shaft 3 is in alignment with the coil.

The reference character 25 represents generally the supporting structure for cowl 11 on the missile during setback, the bearings and the location of the slip-rings which are conventional. FIG. 3 shows a schematic arrangement of the slip-rings. The actual slip-ring structure may be of conventional design, it being only necessary to provide for the desired current collection.

In the missile body itself are the electronics 30–67 which are encapsulated in plastic for stability against the great acceleration encountered during setback. 18 is an A.C. generator for powering the circuit with the permanent magnet rotor attached to the shaft 3.

The mirror, support structure and nose cone are in the retracted position upon firing and are supported by the Belville washer 27. With the onset of setback thrust, the washer 27 is deflected permitting support of the nose by surface 28 and the cowl by surface 25. The generator is supported at 29. Upon release of firing thrust, the Belville washer pushes the nose assembly forward and permits rotation of the nose-shaft-generator-rotor assembly.

Electronics

Referring to FIG. 4 and FIG. 5, an A.C. generator 18 is used to supply power to the entire electronic system. A portion of this energy is rectified and filtered in section 31 to serve as a collector supply for the transistor circuits. The detector 20 will supply target pulses which are amplified by means of the three-stage amplification circuit 67. An automatic gain control 32 adjusts the amplifier gain for variations in the signal level. The effect of this (see FIG. 6 and FIG. 7) is to cause the amplifier to respond only to the strongest pulse from the detector and provide a relatively constant amplitude output from the amplifier. In effect, weaker pulses are essentially sliced out. At far ranges with a weak signal, the gain is high. As the range decreases, the gain will be reduced.

The amplifier output is clamped positive by the clamping diode 33 and rectified and filtered. The diode 55, resistor 56, capacitor 57 and parallel resistor 34 integrate the rectified filtered output of the amplifier. This results in a signal which is proportional to the pulse duration and, hence, the bearing angle.

The operation of the differential amplifier, which for simplicity is described as maintaining the resistor 60 constant, is as follows. When no signal is received by the input transistor 58, the transistor 58 is "off" and, since the transistor 59 has a constant base voltage, the transistor 58 collector voltage is high, causing a flow of current through the motor, turning the motor so as to close the duct 10.

When the signal received by the input transistor is large, the transistor 58 is "on" and with a constant base voltage on reference transistor 59, voltage at the collector of the input transistor will be low, causing currents to flow through the motor in the opposite direction to open the duct 10. The motor is a small direct current, permanent magnet type built to withstand stall.

With the electronics described above, a problem arises in that with pulse durations less than a given figure the motor will be constantly driven to close the duct. Conversely, with higher pulse durations, the motor will open the duct fully.

Since it is desirable to have the duct opening as a function of pulse duration, it is necessary to vary either the output of the integrator as a function of duct opening or preferably to vary the reference voltage on the base of transistor 59.

This is accomplished by providing a variable resistance 60 in the base bias circuit. The resistance 60 is varied by the motor 6 in accord with the degree of opening of duct 10. Accordingly, the dotted line between motor 6 and variable resistor 60 represents a mechanical drive gearing.

Thus, depending on the position of the motor, the resistance 60 is varied, thus changing the reference voltage on transistor 59.

The net result of varying the reference voltage as a function of duct opening is that for any given pulse duration emitted by the target, a corresponding duct opening results rather than a complete closing or opening. Accordingly, for high duration pulses, representing wide bearing angles, the nose is retracted to provide maximum steering. Conversely, for short duration pulses or none at all, representing an on-target condition, the duct is closed, shutting off flow to the jet and resulting in no steering (and minimum drag).

The output of the target amplifier is also fed to a pulse shaping network 36 which is used to trigger a monostable multivibrator 37. The output of the amplifier will be negative-going pulses. The first transistor 62 will normally be "off" and the second transistor 63 will normally be "on" in the absence of pulses. When a signal pulse occurs, the transistors switch, the transistor 63 turns "off" and the transistor 62 turns "on". The capacitor 64 between the collector of the transistor 62 and the base of the transistor 63 determines the "off" period of the transistor 63. The output signal will be a square wave pulse of predetermined amplitude and time. This pulse is applied to the AND gate consisting of two diodes 38 and 39 and a resistor 40. The two resistors 41 and 42 and the clamping diode are used to determine gating levels and to clamp the pulse above ground.

The signal from pickup 12 is amplified in an amplifier 43 which drives a pulse shaping network 65 similar to the one in the target detection circuit. A multivibrator 44 is driven by the network 65 in the same manner that the target detection multivibrator 37 is driven. The output of the multivibrator 44 is also applied to the AND gate. When neither multivibrator is switched from normal condition, the transistor 45 is biased off. The resistor 40 connected to the collector supply voltage assures that the two diodes 38 and 39 are biased in the conducting direction to maintain this transistor 45 cutoff. When the multivibrator 37 is tripped, it supplies a positive-going pulse to the diode 38, cutting off this diode. However, diode 39 still conducts and maintains the bias on the base of the transistor 45 in the cutoff region. When both multivibrators 37 and 44 present positive going pulses simultaneously to diodes 38 and 39, bias resistor 40 can no longer supply current and the base voltage on transistor 45 increases, placing that transistor in a conducting state. When there is no coincidence of pulses the AC generator 18 supplies power through the magnetic clutch 17 to a silicon controlled rectifier 50. When transistor 45 is cut off, the control voltage on the rectifier 50 is maintained high by capacitor 46. The rectifier 50 acts as a diode under these conditions and the magnetic clutch sees a pulsating direct current; that is, power is supplied every positive half-cycle to the magnetic clutch. This causes the cowling to be turned by the nose cone. When the pulses from the multivibrators 37 and 44 are coincident, transistor 45 conducts and shunts capacitor 46. Capacitor 46 tries to charge up between coincident pulses; but the time constant is fixed so that with coincidence pulses arriving at the "AND" gate, capacitor 46 never charges up enough for the rectifier 50 to conduct. Therefore, when the pulses are coincident, no current is supplied to the magnetic clutch.

A target signal from multivibrator 37 is also fed to integrator stage 47. A capacitor 66 in that stage is charged successively higher by sequential pulses. If the pulses are too infrequent, the capacitor will discharge. When sufficient pulses at approximately the correct frequencies are received, the silicon controlled rectifier 51 is fired. This discharges the power supply through the squib 30, blowing the explosive pin and freeing the cowling after target acquisition. In order to provide enough energy to fire the squib, the final capacitor 49 in the power supply will be very large, permitting it to store sufficient energy to ensure firing of the squib. A single transient at this time will not disturb the system sufficiently to cause it to malfunction, particularly since the target and pickup pulses are not yet coincident.

Resistor 48 and capacitor 49 act as a decoupling filter to prevent power transients from entering the amplifier stages through the supply source impedance.

Operation

The operation of the device is as follows. During handling and transportation, the duct 10 (see FIG. 1) is open to minimize the projectile length. Although not within the scope of this invention, it is desirable to provide protection for the assembly, such as a strippable plastic covering.

Upon firing, the nose 1, initially retracted, retracts a further slight distance cushioning on the Belville washer 27. The nose 1 is then supported by the surface 28. Upon cessation of setback, the washer pushes the nose assembly forward to allow rotation of the nose-shaft-generator-rotor assembly. This will energize the electronics.

Assuming that no signals are received from a target, the electronics (see electronic description) activate the motor 6 to drive push rod 4 and nose 1 to its fully extended position in order to close duct 10 and minimize drag.

Upon receipt of sufficient signals from a target through slit 8, the squib 30 in the pin 9 explodes blowing out the pin and diaphragm 13. This frees the cowl 11 and opens the jet 14.

Assuming a wide bearing angle, the duration of the signals received from the target during each scan is relatively long. This will have the effect of actuating the motor 6 to drive the rod 4 to open the cowl duct 10, increasing the flow of air through the jet 14 and maximizing steering action.

To provide proper orientation of the jet to steer the projectile toward the target, the electronic system compares the phase of this signal with a pulse generated in the coil 12 by the reluctance hole 19.

If the pulses are in substantial coincidence, cowl 11 with the exhaust duct 14 is permitted to remain stationary in the air stream due to the forces of the fins 15, thus maintaining the exhaust duct in a constant relationship to the target and providing a constant thrust in the target direction.

In the event the pulses are not coincident, the clutch 17 is energized causing the cowl 11 to be rotated by the nose cone. Such rotation will continue until the pulse comparison previously described indicates that the jet is again properly aligned with the target.

As the steering action decreases the bearing angle, the pulse duration caused by the target is decreased. FIG. 10 shows schematically the duration of pulses 90, 91 and 92 emitted by the detector as a function of bearing angle. This results in the electronics causing the nose 1 to extend and gradually close the duct 10 until the target "disappears" to the detector. At this point the projectile is on line and no more steering action is necessary.

As a further illustration of how the guidance system operates, reference is had to FIG. 8. The target represented by 81 may comprise any source of infrared radiation such as a tank or gun. A mountain range indicated generally at 82 obstructs the view of the target from the firing point 83 making the guidance system particularly useful. On the descending phase of the trajectory 84 and after the explosively actuated pin 9 is removed, the projectile guidance system scans the target area. 85 represents the area visible to the system during a complete scan. 86 represents the scanning area at one position of the cone. At wider bearing angles it is evident that a target will be visible longer than at narrower bearing angles during a scan. It can be seen that the projectile 16 is not on course assuming for discussion purposes that the point at which the longitudinal axis 87 meets the ground coincides with the point of impact without steering.

As discussed previously, the jet will steer the missile toward the target. As the bearing angle decreases, the duct will be closed gradually and when the target is on line a blind spot 80 (which will cover the target 81) inhibits any pulses and the duct is completely closed. Since no steering action is present and the missile is on line with the target, a satisfactory hit will occur.

It should be noted that when the missile is off course, a plane is formed by the longitudinal axis of the missile and the target. Actually since the target is not a point, more than one plane is formed. However, it is simpler to consider the target as a point. The slit 8 will pass radiation from that target only when a part of the slit also lies in that plane, i.e. when it sees the target. At this point the target slit and a vector of force represented by the jet lie on the same line assuming the pulses coincide. Again for simplicity the slit is assumed to pass radiation only at that point although it is obvious that the slit may revolve a finite number of degrees and still pass radiation. When the slit lies in that plane and the jet does not, a driving force on the movable element 11 will result since coincidence has not been achieved.

Although the above description is directed to one embodiment, other components may be utilized without departing from the scope of the invention. For example, the scanning angle could be made smaller or larger. Also the slit 88, although preferably tapered as shown in FIG. 9, could be tapered at other angles. The actual shape and geometry is not critical although for proportional control the duration of pulses must depend on bearing angle. The detector could be any detector capable of generating pulses such as the uncooled Lead-Selenide type.

Under certain conditions it is desirable that the guidance system be selective in the target selection. For example, carbon dioxide has a molecular resonance at 4.3 microns. Due to this resonance infrared transmission through the atmosphere is appreciably attenuated at this frequency so that some light even specularly reflected has a relatively low energy content at this wave length. Conversely, when carbon dioxide is heated above ambient temperature it will radiate most of its energy at this frequency.

An uncooled gold germanium detector has decreasing sensitivity with increasing wave length but is sufficiently sensitive at 4.3 microns. For selective recognition of signals a dichroic mirror which will be non-reflecting at wave lengths shorter than 4 microns is used in combination with the detector. The combined characteristics of the detector and mirror will give a tuned characteristic in the region of 4.3 microns. Accordingly, this system will be relatively insensitive to both shorter and longer radiation making the system essentially sensitive only to hot carbon dioxide. Inasmuch as aggregations of people, fires and vehicular exhaust are all sources rich in hot carbon dioxide, this will give an excellent target selection characteristic.

The nose cone 1 is rotated continuously by the skewed fin 24 and, following target acquisition and selection of a particular target, produces a target pulse each time the slit 8 faces (sees) the target and the target, the slit 8 and the longitudinal axis of the missile lie in a common plane.

The nose cone 1 drives the shaft 3 and AC generator 18 to power the system. The cowl 11, and jet 14, is rotatably mounted on the shaft 3 and is normally held stationary in the air stream by the fins 15. The cowl 11 is rotated by the nose cone 1 when the magnetic clutch 17 is energized. The generator 18 energizes the clutch through SCR 50 which half wave rectifies the generator output. The clutch 17 receives time spaced pulses of current and thus is energized to transmit time spaced pulses of rotational force from the nose cone 1 to the cowl 11. Since the transmission of force from the nose cone 1 to the cowl 11 occurs only in time spaced pulses acting against the stabilizing fins 15, the cowl does not rotate as rapidly as the nose cone.

Target pulses and position pulses, produced when reluctance hole 19 passes coil 12, are non-coincident when the steering jet 14 is not properly oriented.

When the target pulses and position pulses are non-coincident in time, one-half of "AND" gate 38–39 is always unblocked and SCR 50 is in the conducting (half-wave rectifying) state to supply time spaced current pulses to the magnetic clutch 17.

When the jet 14 is oriented by cowl 11 to develop a thrust positioned to steer the missile in the direction of the selected target, the target and position pulses are coincident in time and block both halves of "AND" gate 38–39 to render SCR 50 non-conducting and to de-energize the clutch 17. When the clutch 17 is de-energized, the fins 15 hold the cowl 11, and jet 14, in position to steer the missile toward its selected target.

Sunlight will not ordinarily affect the guidance system as it cannot hold the projectile. The only time it is a significant factor is at sundown or sunrise and if the descending trajectory is pointed toward the sun.

The design of the air foil is not critical since the only purpose of the air foil is to rotate the nose cone. It is necessary that the pulses which are applied should be at a frequency well above the natural period of the round in yaw are effectively integrated by design of the body to produce a net non-zero yaw which provides a guidance force.

In underwater missiles such as torpedoes and particularly depth charges where radiation is appreciably attenuated the guiding energy would preferably be sonic. In this case the slit would be larger and would consist of a segment of high transmission material such as RHO—C rubber and a nose made of foamed material or other attenuating material. Instead of an infrared detector a sonic transducer (or ultrasonic) is used and the mirror eliminated, the transducer receiving the sonic signal directly. The remaining components would operate substantially the same manner with water causing the jet action instead of air.

Although the embodiments discussed so far have been drawn to missiles in flight, it is evident that the same principles apply to an anchored missile such as a depth charge or mine. In this case orientation of the device would be accomplished by a current flowing past the device. For example, a mine could be anchored by a long line in a current of water which will orient itself by reacting to emanation from an approaching boat.

It is further within the scope of this invention that the nose cone instead of being forward could be rearwardly of the projectile. Likewise the jet structure and corresponding electronics could be placed rearwardly. The steering action will be substantially the same although oppositely directed.

It is obvious that the principles of this invention are equally applicable to any projectile as well as bombs, mortar rounds and depth charges. In fact, any missile or device which is either in flight or subjected to fluid current flowing past the nose cone is adapted to these principles.

Although the missile has been described with reference to proportional control, it is within the scope of this invention to eliminate proportional control. In such a missile the cowl duct 10 would be open at all times. This would have the advantage of lower cost and less complication, eliminating the push rod 4, motor 6 and much of the electronics. This is particularly advantageous in smaller missiles. In addition, further simplification is accomplished by eliminating the firing pin.

As another embodiment of this invention it is within the scope thereof to provide for a non-rotatable cowl. Instead, a fixed section attached to the missile is provided with apertures spaced around the periphery. Inside the cowl is a circumferential band with one or more apertures adapted to align with the apertures in the cowl. This band would be driven by a motor arrangement similar to the illustrated embodiment and would have a similar pin, electronics and pickup device. In operation the band as it is rotated exposes one or more apertures in the cowl, thus providing steering similar to FIG. 1 and FIG. 2.

With this construction the rotatable cowl is eliminated, obviating exposure of the rotatable part to the air stream since the circumferential band takes the place of the rotatable cowl.

While various particular embodiments of the invention have been shown it will be observed by those skilled in the art that various changes and modifications may be made without departing from the invention in its broader aspects. Accordingly, the claims appended hereto are intended to cover all such changes and modifications as fall within the scope of this invention.

I claim:

1. A guidance system mounted on a projectile comprising first and second sections mounted on the projectile to rotate about the longitudinal axis thereof, means for rotating said first section when the projectile is in flight, sensor means including a part removed from the longitudinal axis of the projectile rotatable with said first section for receiving emanation from a target and emitting a signal pulse in response thereto when the said part is facing the target and the longitudinal axis of the projectile and the target lie in a straight line, means including said second section for applying a steering force to the projectile at a point rotatable with said second section and directed perpendicularly to the longitudinal axis of the missile, means for rotating said second section when the projectile is in flight, means for generating a position pulse when said first and second sections are in such relation that the steering force tends to steer the missile in the direction in which said part is facing and means responsive to coincidence of said signal and position pulses for deactivating said means for rotating said second section.

2. A projectile guidance system according to claim 1 in which the sensor means which receives the signals is responsive to infrared radiation.

3. Apparatus according to claim 1 including means resisting rotation of said second section for holding said second section against rotation when said means for rotating said second section is deactivated.

4. Apparatus according to claim 1 in which said first and second sections are mounted to move longitudinally of the projectile relatively to each other to open and close a fluid inlet therebetween, and said steering force producing means comprises a sidewardly directed exhaust jet in said second section communicating with said fluid inlet.

5. Apparatus according to claim 4 including means responsive to the bearing angle of a sensed target relative to the trajectory of the projectile to move one of said sections longitudinally of the projectile to decrease the size of the fluid inlet as the bearing angle decreases.

6. Apparatus according to claim 1 wherein said sensor means includes means for reducing the duration of target initiated signal pulses as the bearing angle of the projectile to the target decreases, and means responsive to signal pulse duration for decreasing the steering force as the signal pulse duration decreases.

7. Apparatus according to claim 1 including means for varying the amount of steering thrust on the projectile and said sensor means including means for controlling said thrust varying means to increase and decrease said thrust as the bearing angle of the target to the direction of motion of the projectile increases and decreases respectively.

8. In a missile adapted to be projected through a fluid medium, a guidance system comprising; means for sensing the direction of a target relative to the trajectory of said missile, means for imparting a steering thrust to said missile, to steer said missile toward said target, said steering means comprising a fluid inlet open substantially toward the direction of motion of said missile, means for exhausting fluid admitted to said inlet laterally of said missile at one side thereof to develop sidewardly directed steering thrust on said missile, and means responsive to said sensing means to orient said fluid exhausting means to a position to apply the steering thrust in the direction of a sensed target.

9. Apparatus according to claim 8 including means for varying the size of said fluid inlet to vary the force of the steering thrust, and said sensing means includes means responsive to the bearing of the target relative to the direction of motion of the missile for increasing and decreasing the size of said fluid inlet as the target bearing angle increases and decreases, respectively.

10. In a missile, a guidance system comprising, means responsive to target emanation for producing a signal pulse, scanning means for passing target emanation to said responsive means when the missile, target and scanning means lie in a predetermined relationship, means for rotating said scanning means about the longitudinal axis of the missile, steering means rotatably mounted on the missile, means for rotating said steering means about the longitudinal axis of the missile, means for producing a pulse when said steering means and said scanning means are in predetermined relation to each other, and means for rendering the means for rotating said steering means inoperative when said pulses bear a predetermined relation to each other.

11. Apparatus according to claim 10 in which said steering means comprises a duct directed through the side wall of the steering means and an air inlet passage communicating with said duct and directed forwardly of the missile.

12. Apparatus according to claim 11 in which said passage surrounds a member mounted to move relative to said missile to open and close said passage, and means for closing said passage when said means responsive to target emanation does not emit pulses having a predetermined time spaced relationship.

* * * * *